US006887108B2

(12) United States Patent
Wu

(10) Patent No.: US 6,887,108 B2
(45) Date of Patent: May 3, 2005

(54) ELECTRICAL ADAPTER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 26 days.

(21) Appl. No.: 10/211,464

(22) Filed: Aug. 1, 2002

(65) Prior Publication Data

US 2004/0023559 A1 Feb. 5, 2004

(51) Int. Cl.[7] ..... H01R 25/00; H01R 27/02
(52) U.S. Cl. ..... 439/638; 439/731; 439/904
(58) Field of Search ..... 439/638, 731, 439/732, 904

(56) References Cited

U.S. PATENT DOCUMENTS

| | | | | | |
|---|---|---|---|---|---|
| 3,995,947 | A | * | 12/1976 | Lightner et al. | 439/364 |
| 4,857,016 | A | * | 8/1989 | Benscoter et al. | 439/680 |
| 4,894,630 | A | * | 1/1990 | Ueta et al. | 333/185 |
| 5,466,171 | A | * | 11/1995 | Bixler et al. | 439/378 |
| 6,176,743 | B1 | | 1/2001 | Kuo | |
| 6,217,228 | B1 | | 4/2001 | Samela et al. | |
| 6,273,740 | B1 | * | 8/2001 | Lord | 439/353 |
| 6,331,122 | B1 | * | 12/2001 | Wu | 439/567 |
| 6,340,314 | B1 | * | 1/2002 | Kuo | 439/638 |
| 6,350,154 | B1 | | 2/2002 | Fu | |
| 6,364,713 | B1 | | 4/2002 | Kuo | |
| 6,428,330 | B1 | * | 8/2002 | Poulter et al. | 439/76.1 |
| 2003/0008565 | A1 | * | 1/2003 | Chang | 439/638 |

* cited by examiner

*Primary Examiner*—Hae Moon Hyeon
(74) *Attorney, Agent, or Firm*—Wei Te Chung

(57) ABSTRACT

An electrical adapter (10) includes a serial advanced technology attachment (serial ATA) receptacle connector (20), a single connector attachment 2 (SCA2) plug connector (30), a printed circuit board (40) and a pair of covers (50). The serial ATA receptacle connector and the SCA2 plug connector are respectively electrically and mechanically connected to the printed circuit board. The printed circuit board performs the functions of signal transmission and conversion between the serial ATA receptacle connector and the SCA2 plug connector. The pair of covers are assembled to the subassembly of the serial ATA receptacle connector, the SCA2 plug connector and the printed circuit board, and finally combined with each other to fasten the electrical adapter. The electrical adapter interconnects the SCA2 interface with the serial ATA interface.

9 Claims, 12 Drawing Sheets

ELECTRICAL ADAPTER

BACKGROUND OF THE INVENTION

1. Field of the Invention

The present invention relates to an electrical adapter, and particularly to an electrical adapter for interconnecting two connectors of different interface standard.

2. Description of Related Art

In the recent years, single connector attachment (SCA) becomes a popular connection interface. The SCA interface was designed to provide a standard connection for system and was followed by a second version called the SCA2. Unless otherwise specified, the use of the term of SCA2 here includes both original SCA as well as its descendant, the SCA2. Generally, an SCA2 receptacle connector is mounted on a fibre channel backplane in the computer and an SCA2 plug connector is connected to a hard drive which is adapted to be attached to the fibre channel backplane for establishing signal transmission between the hard drive and the fibre channel backplane through the interconnection of such SCA2 receptacle and plug connectors.

Now, the Serial Advanced Technology Attachment (serial ATA) interface is developing to connect storage devices such as hard disks, DVD, and CD-RW drives to the PC motherboard. The storage devices will be collectively referred to hereinafter as "hard drive". The serial ATA interface offers more advantages compared to prior specialized interfaces. For example, the serial ATA system supports a low voltage requirement, low pin count, improves data robustness and high speed transmission. Correspondingly, the serial ATA connectors are defined and are provided to respectively connect hard drive and backplane. Therefore, different interface standard connection may be applied in a computer interior structure.

As stated above, the present problem people in the art confronts, is that a hard drive using a serial ATA plug connector may be required to connect with an existing fibre channel backplane which originally uses an SCA2 receptacle connector to connect with the hard drive, for the speed or other considerations. Under this situation, it is not convenient to wholly replace the system, which adds cost. Accordingly, an electrical adapter interconnecting the serial ATA plug connector and the SCA2 receptacle connector is desired.

Hence, an electrical adapter for interconnecting the connectors of different interface standard is required to overcome the disadvantages of the related art.

SUMMARY OF THE INVENTION

Accordingly, an object of the present invention is to provide an electrical adapter for electrically interconnecting a serial ATA plug connector and an SCA2 receptacle connector.

In order to achieve the object set forth, an electrical adapter in accordance with the present invention includes a serial ATA receptacle connector, an SCA2 plug connector, a printed circuit board and a pair of covers. The serial ATA receptacle connector and the SCA2 plug connector are electrically and mechanically connected to the printed circuit board respectively. The printed circuit board performs the functions of signal transmission and conversion between the serial ATA receptacle connector and the SCA2 plug connector. The pair of covers are assembled to the subassembly of the serial ATA receptacle connector, the SCA2 plug connector and the printed circuit board, and finally combined with each other to fasten the electrical adapter.

Other objects, advantages and novel features of the invention will become more apparent from the following detailed description when taken in conjunction with the accompanying drawings.

DETAILED DESCRIPTION OF THE INVENTION

Figure 1:
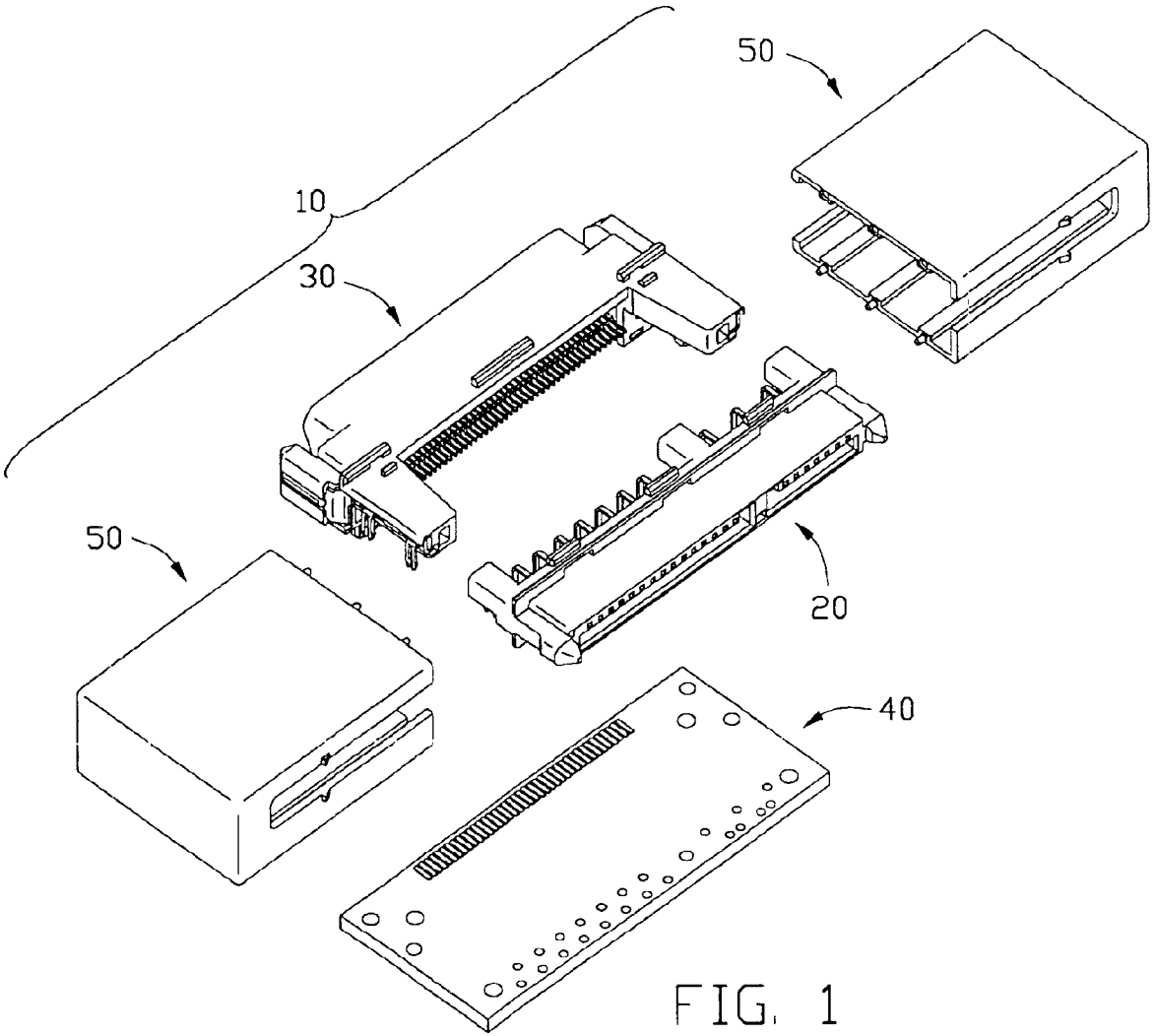
FIG. 1 is an exploded, perspective view of an electrical adapter in accordance with the present invention.
Figure 2:
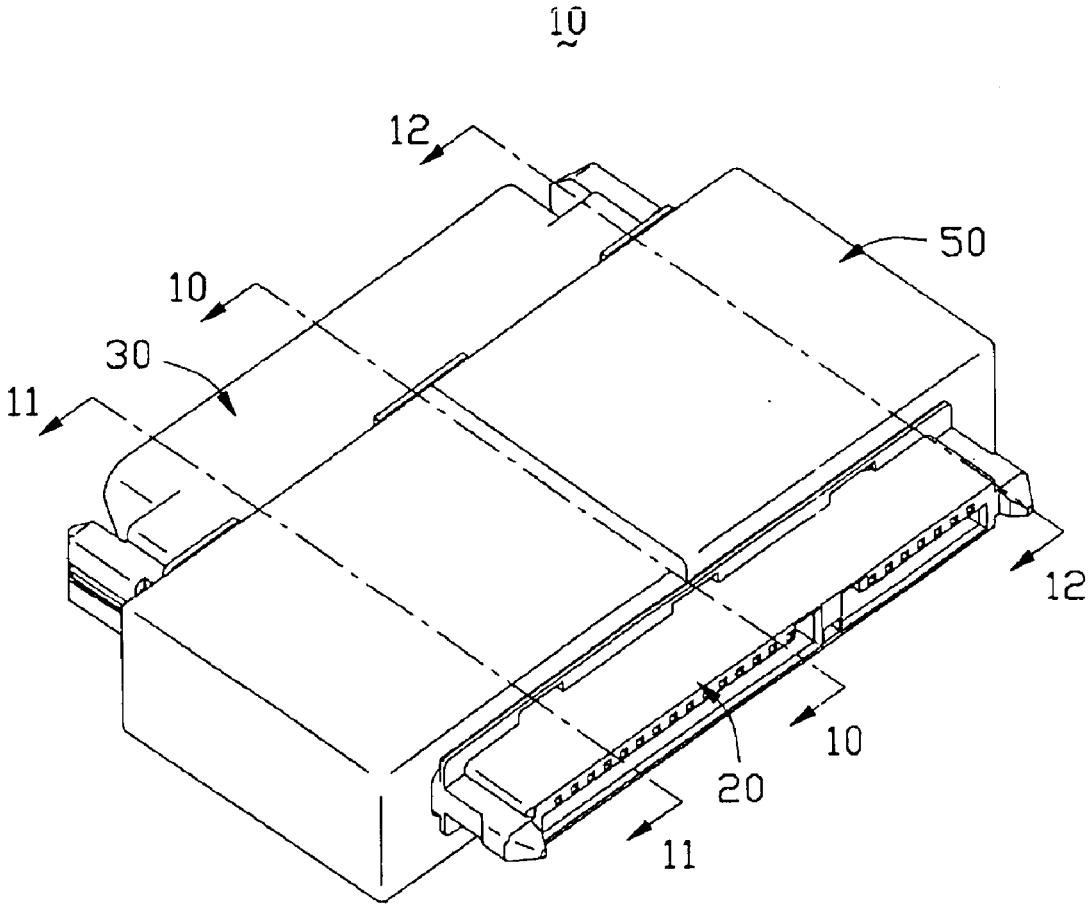
FIG. 2 is an assembled perspective view of the electrical adapter of FIG. 1.

Referring to FIGS. 1–2, an electrical adapter 10 in accordance with the present invention comprises a serial advanced technology attachment (serial ATA) receptacle connector 20, a single connector attachment 2 (SCA2) plug connector 30, a printed circuit board (PCB) 40, and a casing composed of a pair of dielectric covers 50. The electrical adapter 10 is designed to connect a serial ATA plug connector (not shown) of a hard drive and an SCA2 receptacle connector (not shown) mounted on a fibre channel backplane.

Figure 3:
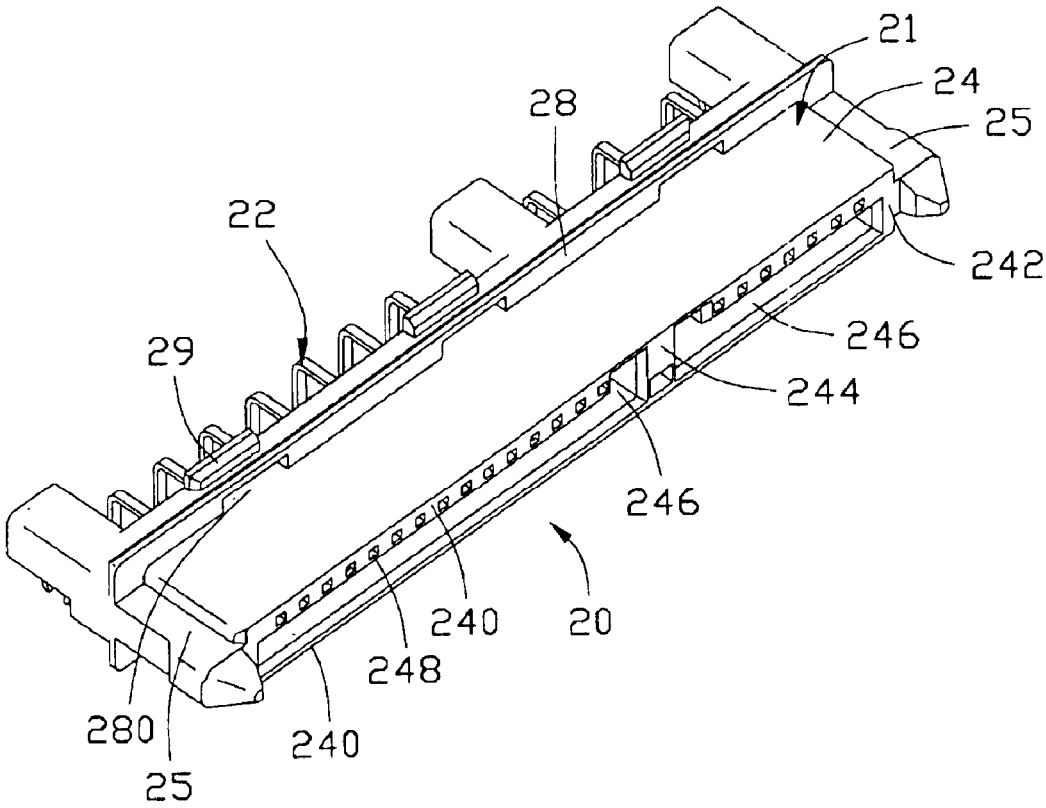
FIG. 3 is a perspective view of a serial ATA receptacle connector of the electrical adapter of FIG. 1 from a front aspect.
Figure 4:
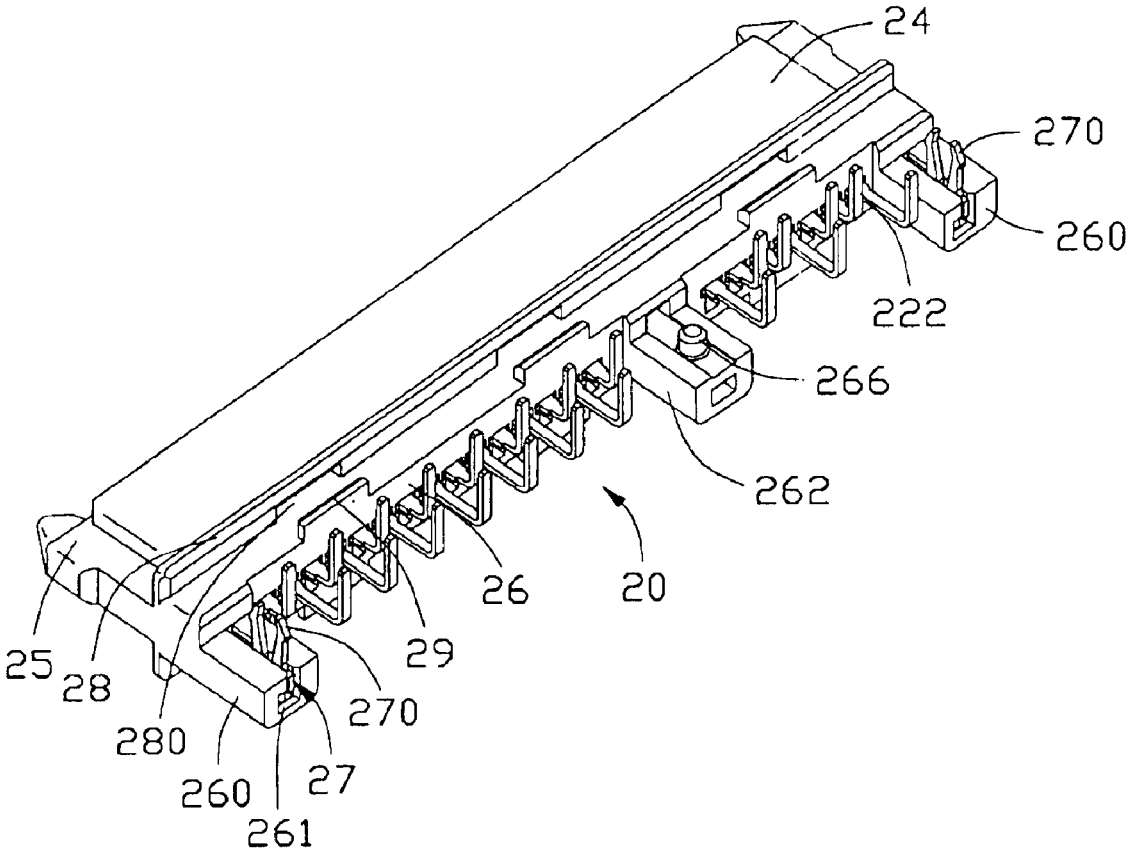
FIG. 4 is a perspective view of the serial ATA receptacle connector of FIG. 3 from rear and bottom aspects.

Also referring to FIGS. 3–4, the serial ATA receptacle connector 20 comprises an insulative housing 21 and a plurality of contacts 22. The housing 21 has an elongate first base 24. The first base 24 includes a pair of longitudinal sidewalls 240, a pair of lateral ends 242 connecting opposite ends of the longitudinal sidewalls 240, and an intermediate wall 244 extending parallel between the lateral ends 242 and connecting with the longitudinal sidewalls 240. The longitudinal sidewalls 240, the lateral ends 242 and the intermediate wall 244 together define two receiving slots 246 therebetween. One of the slots 246 has a longitudinal dimension larger than the other of the slots 246. One of the longitudinal sidewalls 240 is thicker than the other of the longitudinal sidewalls 240 and defines a plurality of passageways 248 communicating with corresponding receiving slots 246. A pair of guiding posts 25 is disposed adjacent to the lateral ends 242 of the housing 21.

The first base 24 of the housing 21 further has an abutment surface 26, as best shown in FIG. 4. A pair of side protrusions 260 extends backward away from the abutment surface 26 at opposite ends of the first base 24. Each side protrusion 260 defines a slot 261. The slot 261 is adapted to receive a corresponding board lock 27 having a pair of resilient legs 270, which is known to persons skilled in the art and the detailed description thereof is omitted here. A middle protrusion 262 projects from the abutment surface 26 and is aligned with the intermediate wall 244. A post 266 projects from the middle protrusion 262 for being inserted into a corresponding post receiving hole 462 (FIG. 7) in the PCB 40, which will be described in detail later.

A pair of opposite bars 28 respectively projects upwardly and downwardly from the first base 24 of the serial ATA housing 21. Each, bar 28 defines a plurality of holes 280 therein. A corresponding number of projections 29 extends upwardly and downwardly from the first base 24 of the housing 21 proximate to the abutment surface 26. The shape and dimension of each projection 29 is similar/equal to that of the holes 280 of the bars 28.

Figure 7:
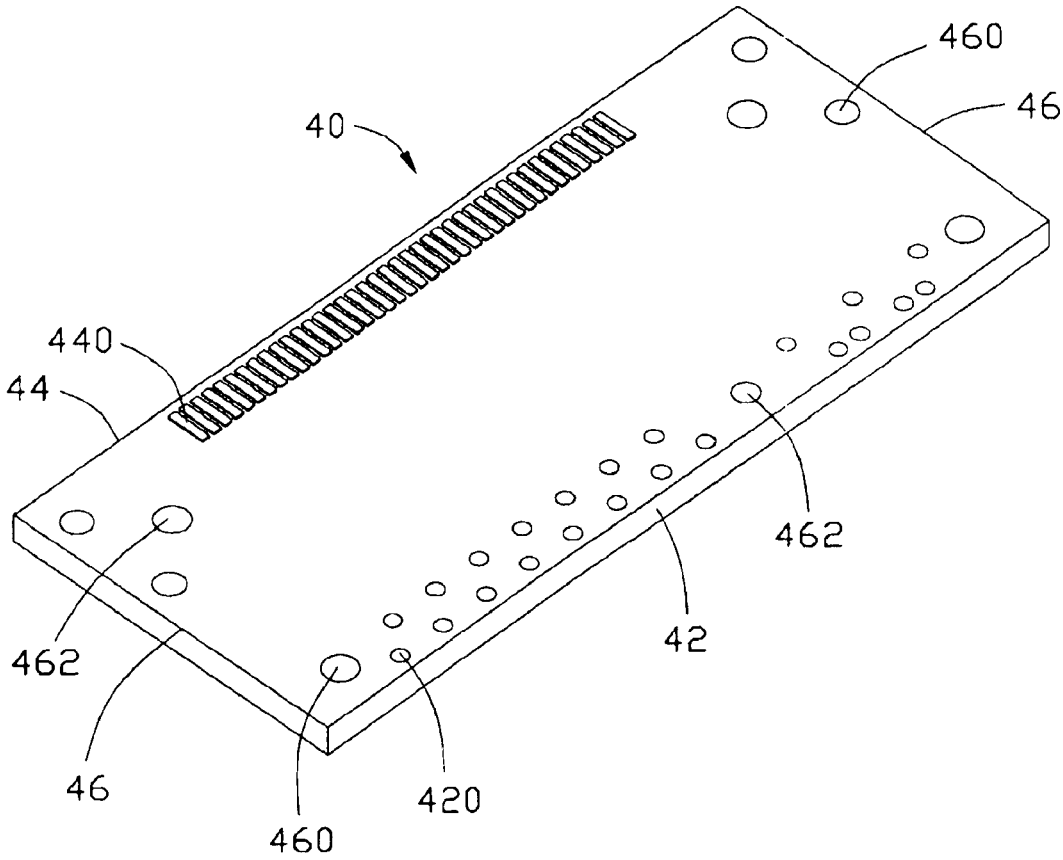
FIG. 7 is a perspective view of a printed circuit board of the electrical adapter of FIG. 1.
Figure 10:
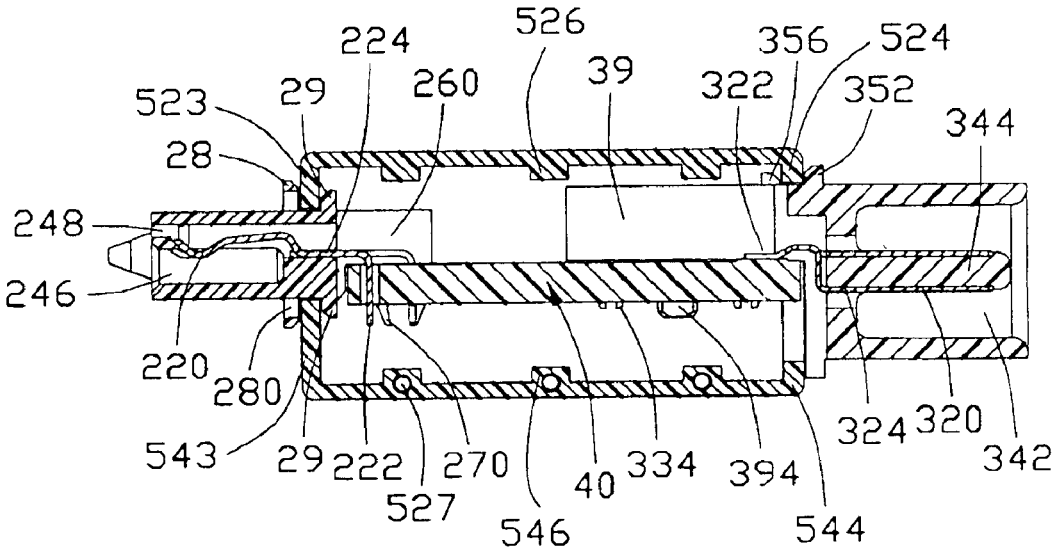
FIG. 10 is a cross-sectional view taken along section line 10—10 of FIG. 2.
Figure 11:
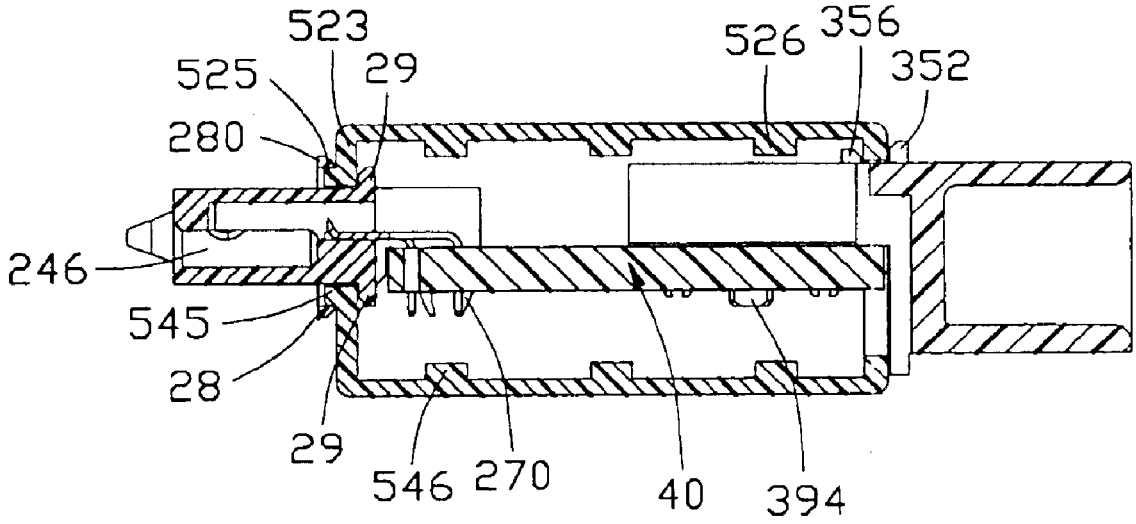
FIG. 11 is a cross-sectional view taken along section line 11—11 of FIG. 2.

Each contact 22, referring to FIG. 4 in conjunction with FIG. 10, generally comprises a contact portion 220, a mounting portion 222, and a connection portion 224 connecting the contact portion 220 and the mounting portion 222. In assembly, the contacts 22 are inserted into the passageways 248 from the abutment surface 26 of the housing 21. Each contact portion 220 partially projects into a corresponding receiving slot 246 adapted to mate with a corresponding contact of the complementary serial ATA plug connector. The connection portion 224 of each contact 22 engages with the housing 21 and provides a secure and stable retention between the contact 22 and the housing 21. The mounting portion 222 of each contact 22 extends outwardly beyond the abutment surface 26 and bends downwardly for being inserted into a corresponding plated through hole 420 in the PCB 40 (FIG. 7).

Figure 5:
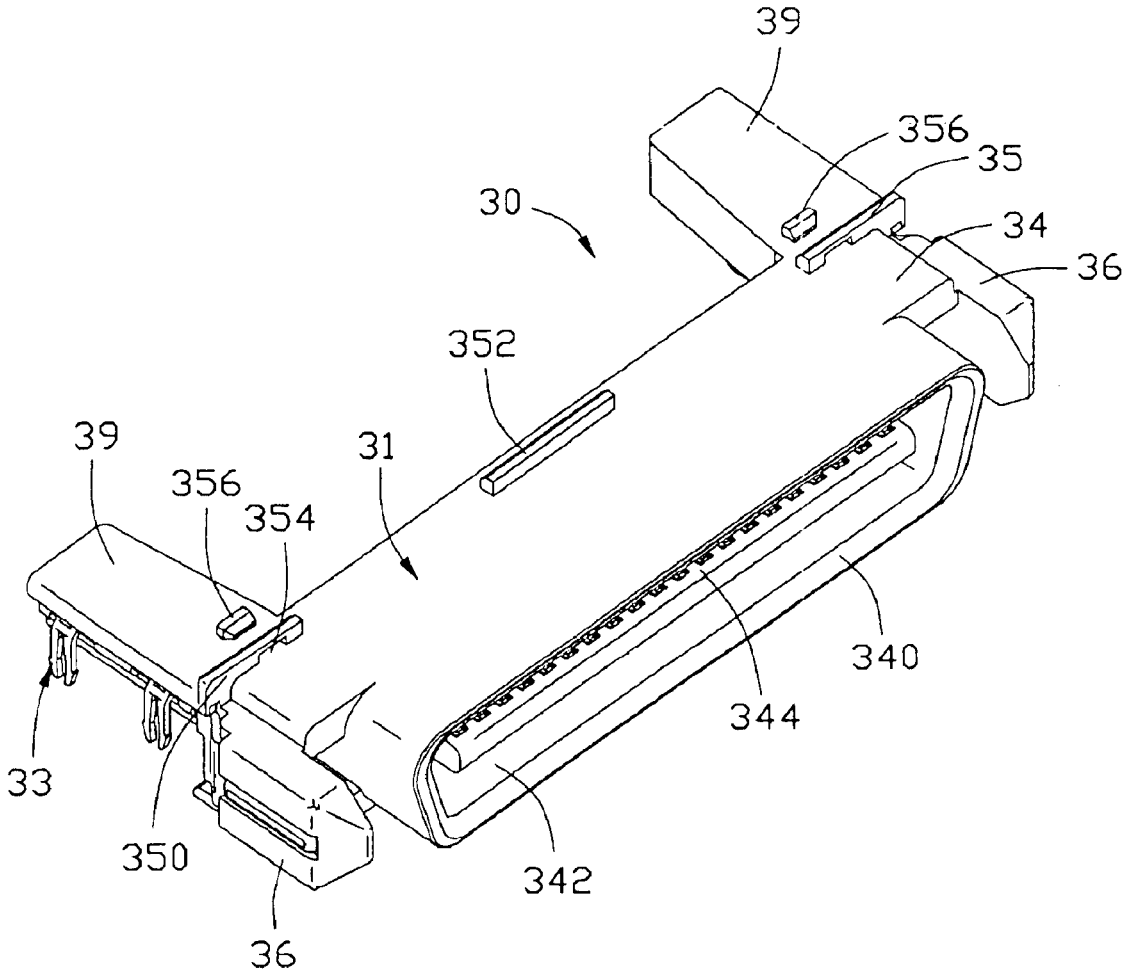
FIG. 5 is a perspective view of an SCA2 plug connector of the electrical adapter of FIG. 1.
Figure 6:
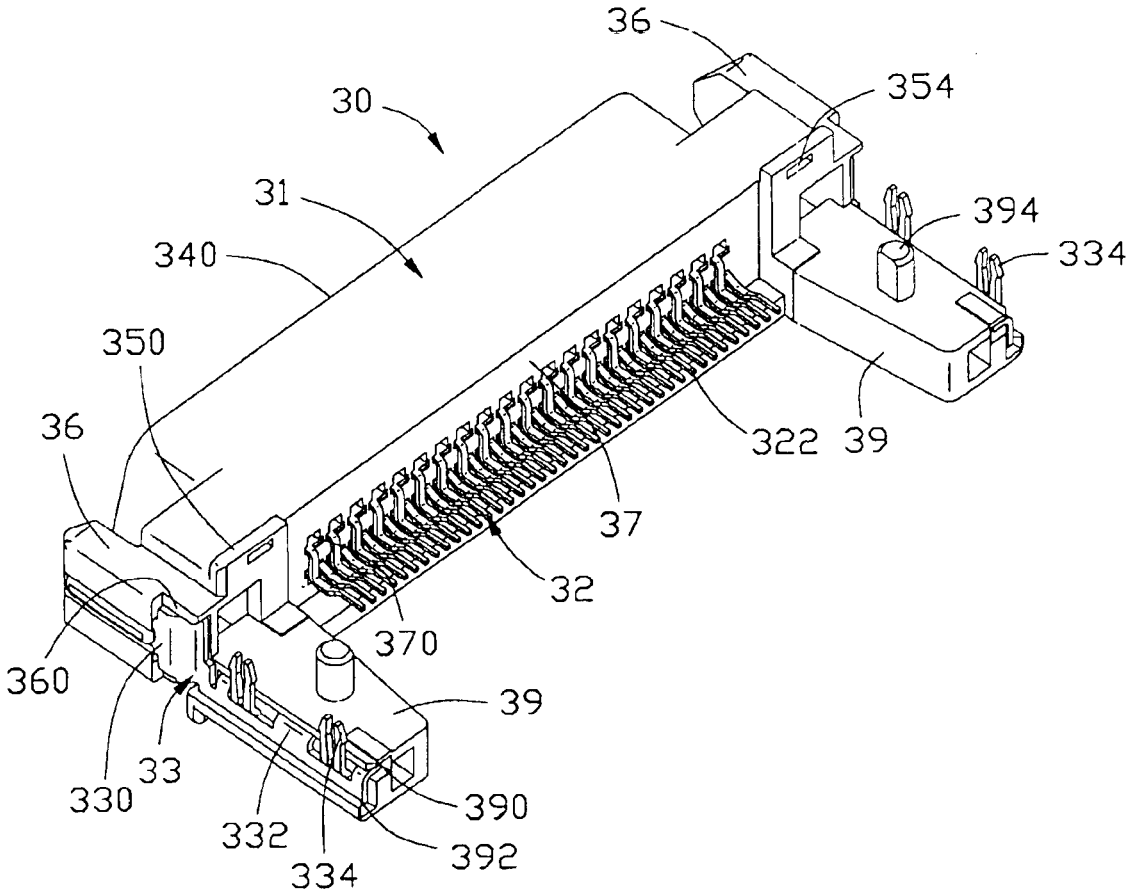
FIG. 6 is another perspective view of the SCA2 plug connector of FIG. 5 taken from a different perspective.

The SCA2 plug connector 30, as shown in FIGS. 5–6, comprises an insulative housing 31, a plurality of contacts 32 and a pair of board locks 33. The housing 31 includes a second base 34 having a forwardly projecting shroud 340 defining a cavity 342 therein. A tongue 344 extends horizontally into the cavity 342. A pair of alignment posts 36 is disposed at opposite ends of the second base 34, each of which defines a channel 360 for receiving a first portion 330 of a corresponding board lock 33.

The second base 34 of the housing 31 further has a rear abutment surface 37. A plurality of passageways 370 extends from the rear abutment surface 37 through the base 34 and into the tongue 344 for receiving corresponding contacts 32 therein. A pair of rear arms 39 extends from the rear abutment surface 37 of the housing 31 and adjacent to opposite ends of the second base 34. Each rear arm 39 defines a first groove 390 and a second groove 392 communicating with each other. The first groove 390 and the second groove 392 cooperatively receive a second portion 332 of a corresponding board lock 33. Each board lock 33 further comprises a pair of resilient legs 334 projecting downwardly from a side edge of the second portion 332 and extending out of the second groove 392. Each rear arm 39 further comprises a post 394 extending downwardly therefrom for being inserted into a corresponding post receiving hole 462 in the PCB 40 (FIG. 7).

A pair of upper and lower bars 35 extends from the second base 34 of the housing 31 adjacent to the rear abutment surface 37. The upper bar 35 comprises a pair of side bars 350 at opposite ends of the second base 34 and a middle bar 352 at a central portion of the second base 34 of the housing 31. The lower bar 35 includes a pair of side bars 350. Each side bar 350 defines a rectangular hole 354 therein. A pair of projections 356 protrudes upwardly from the rear arms 39 of the housing 31 and is aligned with corresponding holes 354.

Each contact 32, referring to FIGS. 5–6 in conjunction with FIG. 10, also comprises a contact portion 320, a mounting portion 322, and a connection portion 324 connecting the contact portion 320 and the mounting portion 322. The contacts 32 are assembled into the passageways 370 from the rear abutment surface 37 of the housing 31. The mounting portion 322 of each contact 32 extends outwardly beyond the rear abutment surface 37 for being soldered on a corresponding solder pad 440 of the PCB 40 (FIG. 7).

FIG. 7 shows the PCB 40, which is rectangular and has a front side 42, a rear side 44 and a pair of lateral sides 46. A plurality of through holes 420 is defined in the PCB 40 adjacent to the front side 42 and a plurality of board lock receiving holes 460 is defined in the PCB 40 adjacent to the lateral sides 46 of the PCB 40. The PCB 40 further defines a plurality of post receiving holes 462 therein. A plurality of solder pads 440 is attached on an upper surface of the PCB 40 adjacent to the rear side 44 thereof.

Figure 8:
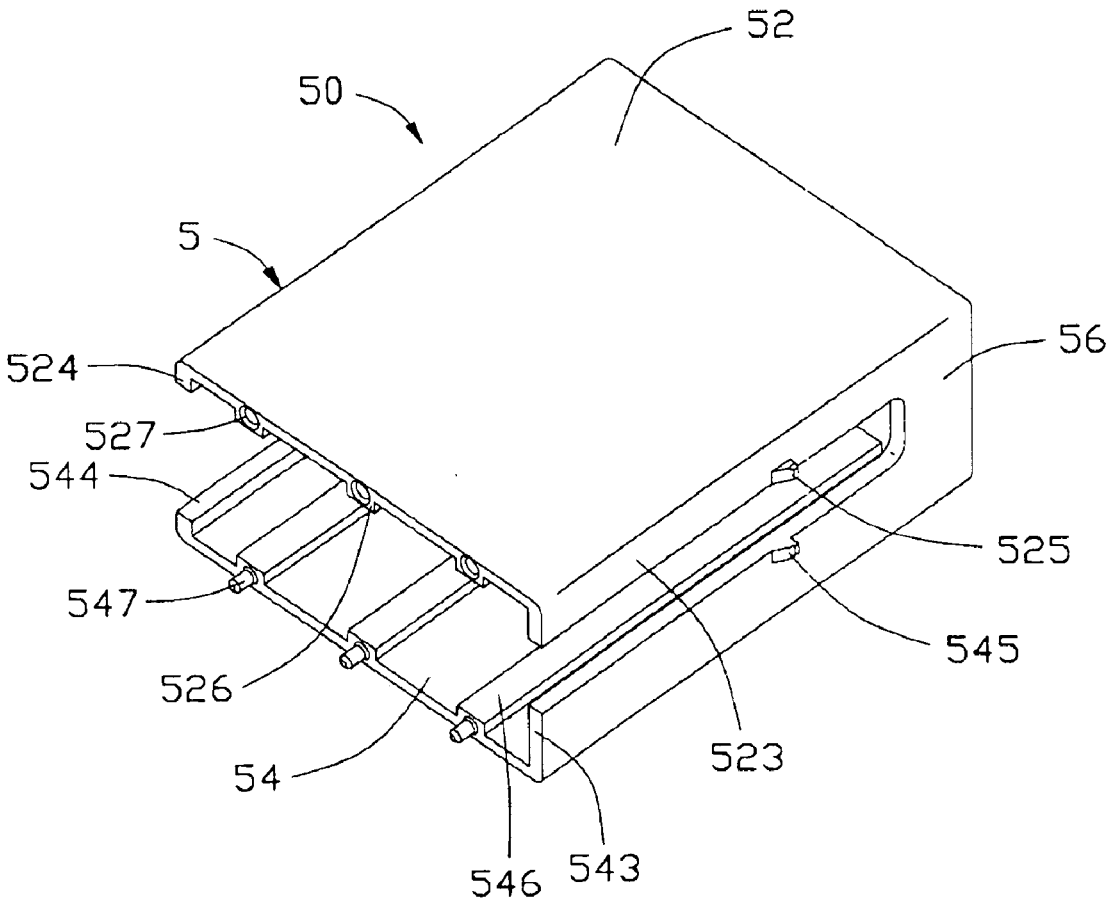
FIG. 8 is a perspective view of a cover of the electrical adapter of FIG. 1.
Figure 9:
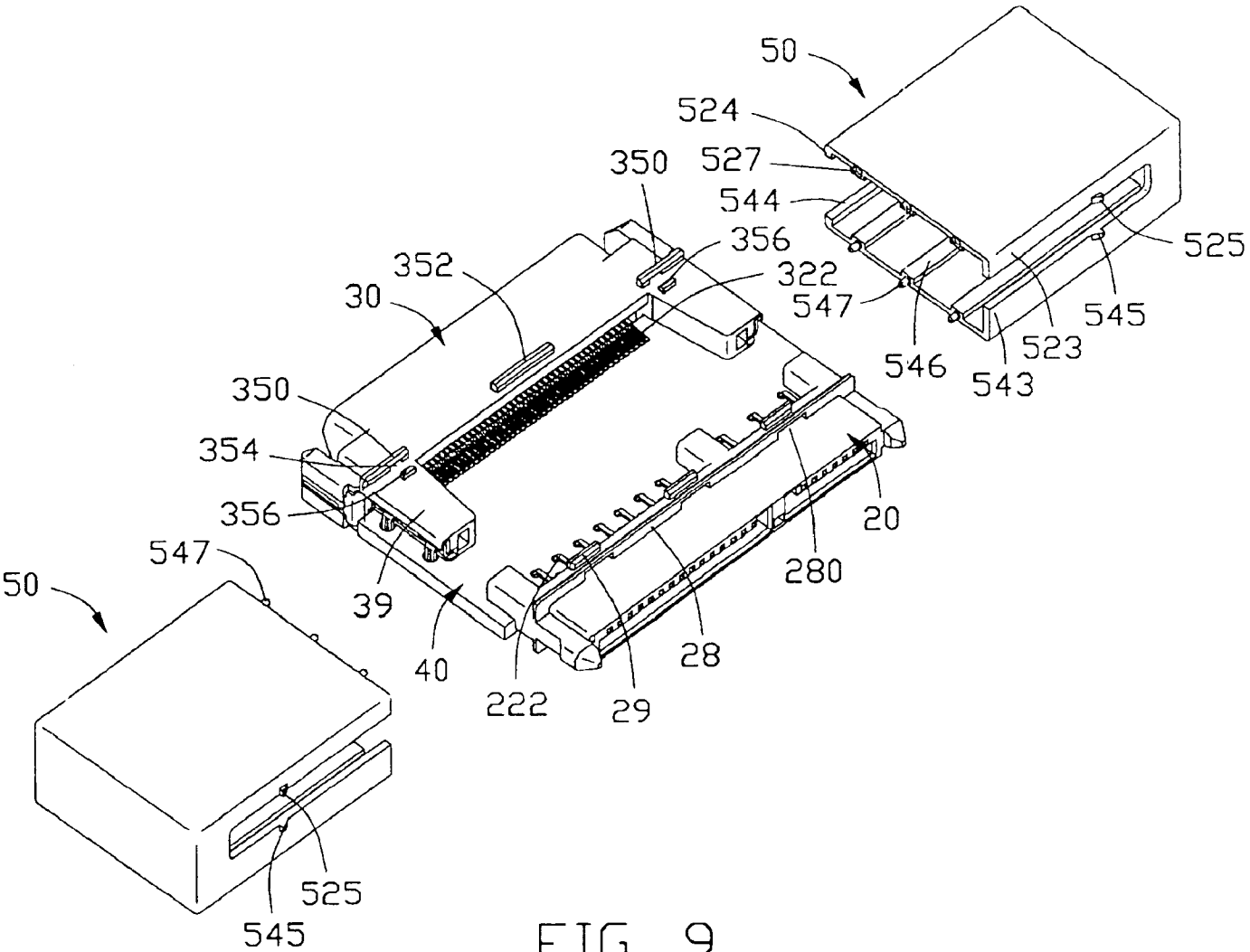
FIG. 9 is a perspective view showing a serial ATA receptacle connector, an SCA2 plug connector and a printed circuit board of FIG. 1 assembled together.

As shown in FIG. 1, FIG. 8 and FIG. 9, the pair of covers 50 includes a left cover 50 and a right cover 50 of a similar configuration and opposite to each other. Each cover 50 has an upper portion 52, a lower portion 54, and a lateral portion 56 connecting the upper portion 52 and the lower portion 54. The upper portion 52 and the lower portion 54 are similar in shape and dimension. Each portion 52 (54) has a front beam 523 (543) and a rear beam 524 (544) respectively extending downwardly/upwardly therefrom. The front beam 523 (543) and the rear beam 524 (544) respectively have a plurality of barbs 525 (545). Each portion 52 (54) further has a plurality of ribs 526 (546) extending parallel to the front beam 523 (543) and the rear beam 524 (544). Each rib 546 of the lower portion 54 of the right cover 50 and each rib 526 of the upper portion 52 of the left cover 50 respectively has a post 547 protruding outwardly therefrom. Each rib 526 of the upper portion 52 of the right cover 50 and each rib 546 of the lower portion 54 of the left cover 50 respectively defines a hole 527 corresponding to the post 547.

Referring particularly to FIGS. 3, 4, 7 and 9, in assembly, the serial ATA receptacle connector 20 is attached to the PCB 40, with the abutment surface 26 thereof abutting against the front side 42 of the PCB 40. The mounting portions 222 of the contacts 22 are first inserted into corresponding through holes 420 in the PCB 40 and then soldered thereto. The resilient legs 270 of the board locks 27 and the post 266 of the connector 20 are respectively inserted into corresponding board lock receiving holes 460 and post receiving hole 462 adjacent to the front side 42 of the PCB 40.

To assemble the SCA2 plug connector 30 to the PCB 40, referring particularly to FIGS. 5–7 and 9, the rear abutment surface 37 of the SCA2 plug connector 30 abuts against the rear side 44 of the PCB 40. The mounting portion 322 of each contact 32 is soldered on a corresponding solder pad 440 of the PCB 40. Simultaneously, the resilient legs 334 of the board locks 33 and the posts 394 of the SCA2 plug connector 30 are respectively inserted into corresponding board lock receiving holes 460 and post receiving holes 462 adjacent to the rear side 44 of the PCB 40.

Figure 12:
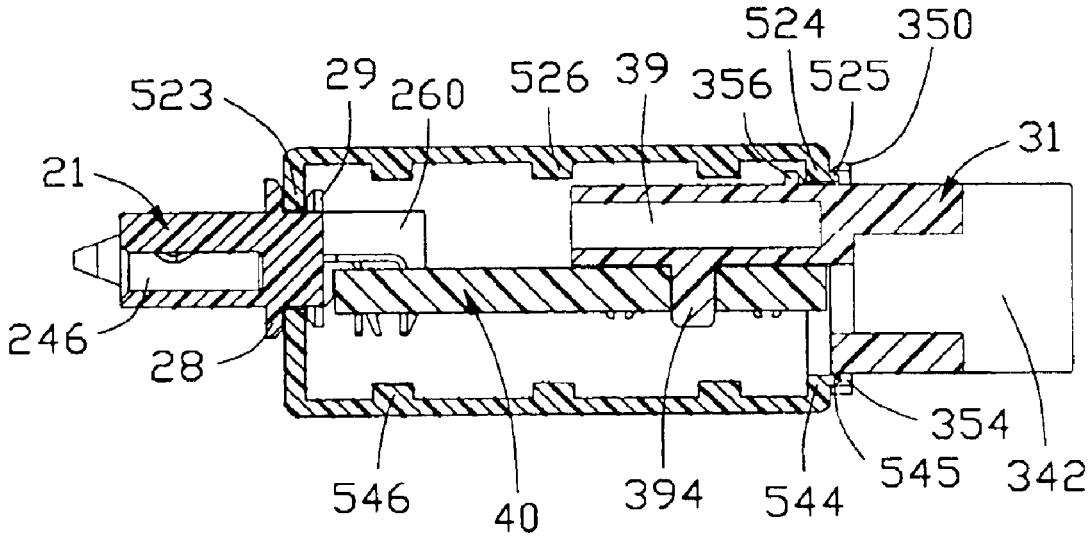
FIG. 12 is a cross-sectional view taken along section line 12—12 of FIG. 2.

The pair of covers 50 are finally assembled to the subassembly of the serial ATA receptacle connector 20, the PCB 40 and the SCA2 plug connector 30 respectively from the lateral sides. Referring to FIGS. 9–12, each front beam 523, 543 of the cover 50 is sandwiched between a corresponding bar 28 and the projections 29 of the housing 21, with each barb 525, 545 thereof fitting into a corresponding hole 280 of the bar 28 of the serial ATA receptacle connector 20 (best shown in FIG. 11). Simultaneously, each rear beam 524, 544 of the cover 50 is sandwiched between a corresponding bar 35 and the projections 356 of the housing 31. As shown in FIG. 12, each barb 525, 545 of the rear beam 524, 544 fits into the hole 354 of a corresponding side bar 350 of the housing 31.

It should be noted that each cover 50 has a plurality of posts 547 and a plurality of holes 527 aligned with the posts 547. When the left, right covers 50 are assembled, each post 547 of the left cover (right cover) 50 inserts into a corresponding hole 527 of the right cover (left cover) 50 for combining the left cover 50 and the right cover 50 together. Thus, the serial ATA receptacle connector 20 and the SCA2 plug connector 30 so far are connected to the PCB 40 and are fastened with each other by the covers 50. Therefore, an electrical adapter 10 for mating with a serial ATA plug connector and an SCA2 receptacle connector on opposite ends thereof is accomplished.

The PCB 40 can performs the functions of signal transmission and conversion, allowing the electrical adapter 10 to electrically interconnect with different interface standard connectors, such as an SCA2 receptacle connector and a serial ATA plug connector. The connectors of different interface standard can be applied in a system, thus, the system need not be wholly replaced and the cost will be saved accordingly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter comprising:

a printed circuit board (PCB) having a front side and a rear side;

a first connector mounted on the front side of the PCB;

a second connector mounted on the rear side of the PCB; and a pair of left and right covers assembled to the subassembly of the first connector, the second connector and the PCB, each cover having an upper portion, a lower portion, and a lateral portion connecting the upper portion and the lower portion;

wherein each of the first connector and the second connector comprises an insulative housing having a pair of opposite bars projecting upwardly/downwardly therefrom and at least one projection spaced from a corresponding bar, and each cover has a pair of front beams and a pair of rear beams respectively extending downwardly/upwardly from the upper/lower portions thereof for being sandwiched between corresponding bars and projections of the first connector and the second connector.

2. The electrical adapter as claimed in claim 1, wherein the PCB defines a plurality of plated through holes adjacent to the front side thereof, and the first connector comprises a plurality of contacts having mounting portions inserted into corresponding through holes of the PCB and then soldered thereto.

3. The electrical adapter as claimed in claim 1, wherein the PCB comprises a plurality of solder pads adjacent to the rear side thereof, and the second connector comprises a plurality of contacts having mounting portions soldered on corresponding solder pads.

4. The electrical adapter as claimed in claim 1, wherein the upper and lower portions of each cover respectively have a plurality of inwardly protruding ribs.

5. The electrical adapter as claimed in claim 4, wherein each rib of the lower portion of the right cover has a post protruding outwardly therefrom, and each rib of the lower portion of the left cover defines a hole for receiving a corresponding post of the right cover.

6. The electrical adapter as claimed in claim 4, wherein each rib of the upper portion of the right cover defines a hole therein, and each rib of the upper portion of the left cover has a post for being inserted into a corresponding hole of the right cover.

7. The electrical adapter as claimed in claim 1, wherein each bar of the first connector and the second connector defines a plurality of holes, and each of the front and rear beams of each cover has a barb fitting into a corresponding hole of a corresponding bar.

8. The electrical adapter as claimed in claim 1, wherein each housing of the first connector and the second connector comprises at least one post thereof, and the PCB defines a corresponding number of post receiving holes for receiving corresponding posts.

9. The electrical adapter as claimed in claim 1, wherein each of the first connector and the second connector comprises a pair of board locks, and the PCB defines four board lock receiving holes for receiving corresponding board locks.

* * * * *